US006553618B2

(12) United States Patent
Whitley

(10) Patent No.: US 6,553,618 B2
(45) Date of Patent: Apr. 29, 2003

(54) DUAL DUROMETER ROLLER GUIDE MEMBER FOR TRACK GUIDED DOOR

(75) Inventor: L. Blake Whitley, Arlington, TX (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/846,646

(22) Filed: May 1, 2001

(65) Prior Publication Data

US 2002/0162189 A1 Nov. 7, 2002

(51) Int. Cl.[7] ..... A47H 15/00

(52) U.S. Cl. ..... 16/91; 16/107; 16/45; 160/201

(58) Field of Search ..... 16/91, 107, 45; 160/201

(56) References Cited

U.S. PATENT DOCUMENTS

| | | | | |
|---|---|---|---|---|
| 2,850,333 A | | 9/1958 | Hamman | |
| 2,912,288 A | | 11/1959 | Griswold, Jr. | |
| 3,243,237 A | | 3/1966 | Sprecher | |
| 3,301,610 A | | 1/1967 | Packett et al. | |
| 3,361,489 A | | 1/1968 | Gionet | |
| 3,433,537 A | | 3/1969 | Seeloff et al. | |
| 3,614,804 A | * | 10/1971 | Grellsson | 16/21 |
| 3,708,827 A | * | 1/1973 | Foltz | 16/107 |
| 3,793,673 A | * | 2/1974 | Lawrence, Jr. | 16/103 |
| 4,205,713 A | * | 6/1980 | Galbreath | 160/201 |
| 4,379,479 A | * | 4/1983 | Whiting | 16/97 |
| 4,402,556 A | | 9/1983 | Schwind | |
| 4,601,521 A | | 7/1986 | Foulke | |
| 4,606,657 A | | 8/1986 | Tanaka | |
| 4,639,145 A | | 1/1987 | Lautenschlager | |
| 4,647,225 A | | 3/1987 | Grass | |
| 4,867,579 A | | 9/1989 | Gallone | |
| 4,878,630 A | | 11/1989 | Schmid | |
| 4,944,608 A | | 7/1990 | Osawa | |
| 5,022,768 A | | 6/1991 | Baxter | |
| 5,090,820 A | | 2/1992 | Lautenschlager | |
| 5,169,237 A | | 12/1992 | Domenig | |
| 5,275,473 A | | 1/1994 | Hicks | |
| 5,468,070 A | | 11/1995 | Riedel et al. | |
| 5,487,610 A | | 1/1996 | Lautenschlager | |
| 6,185,783 B1 | * | 2/2001 | Carpinella | 16/107 |

OTHER PUBLICATIONS

"Interstate Plastics Materials", Natural Nylatron® (http://www.interstateplastics.com/meta/fmnylatr.htm). No Date.*

"Polyurethane Hardness and Resilience", Griffith Polymers Inc., Oct. 5, 1999 (http://home.pacifier.com/~polyu/hardness.htm).*

* cited by examiner

*Primary Examiner*—Thomas B. Will
*Assistant Examiner*—Alexandra Pechhold
(74) *Attorney, Agent, or Firm*—Gardere Wynne Sewell LLP

(57) ABSTRACT

Guide rollers for upward-acting track guided doors are formed of dual durometer plastic materials wherein a hub portion of the guide roller is formed of a relatively hard moldable plastic material having a durometer of about Rockwell R 120. A tire or tread is preferably molded over the hub and is characterized by a thermoplastic elastomer material, such as urethane, having a durometer of about 70 to 90 Shore A. A circumferential recess may be formed in the rim of the roller hub to receive a tread which is not molded over the full extent of the rim. The tire or tread may have an arcuate thin-walled, a somewhat elliptical or a circular segment shape in cross section. The guide roller provides for quiet long-lasting operation in guiding upward-acting sectional and one-piece garage doors and the like.

11 Claims, 5 Drawing Sheets

DUAL DUROMETER ROLLER GUIDE MEMBER FOR TRACK GUIDED DOOR

FIELD OF THE INVENTION

The present invention pertains to a dual durometer roller type guide member for use with upward-acting track guided garage doors and the like.

BACKGROUND OF THE INVENTION

Upward-acting track guided sectional and one piece garage doors are typically supported and guided for movement between their closed and open positions by plural roller type guide members which are mounted on the door side edges and which engage and traverse along opposed guide tracks. Such guide tracks are typically formed as somewhat channel shaped members which are manufactured of formed metal plate. Moreover, conventional roller type guide members are characterized by formed metal rollers mounted on metal shafts. These metal on metal guide structures for upward-acting residential garage doors and other types of doors tend to generate a substantial amount of noise during opening and closing movement of the door and also on occasions when substantial and variable wind loads act on the door. Such roller guide member generated noise is objectionable in most door installations and it is desirable to eliminate such noise and to provide for long lasting, low friction, vibration free and quiet operation of such doors. It is to these ends that the present invention has been developed.

SUMMARY OF THE INVENTION

The present invention provides an improved track guided door including roller guide members which are quiet and reliable in operation.

In accordance with one important aspect of the invention, an upward-acting track guided door is provided with roller guide members disposed in opposed guide tracks and which guide members are each provided with an elastomer tire or tread, respectively, to provide quiet, reliable operation when the door is moved between open and closed positions and when the door may be subject to deflection due to wind loads and the like while in the closed position, in particular. The roller guide members are preferably formed of dual durometer plastic construction including a thermoplastic hub over which is molded a thermoplastic elastomer outer layer forming the so-called tread or tire portion which is of a softer or lower durometer than the hub portion. The roller guide members are preferably formed by a molding process wherein the hub is formed in a first molding step, the mold is expanded or modified and the tread portion is molded over the hub in a second molding step without removing the hub from the mold structure. A strong bond between the hub and the tread is formed in the molding process.

In accordance with a further aspect of the present invention, a dual durometer roller guide member is provided for use with track guided and upward-acting doors, in particular, and wherein the guide member is formed of dual durometer construction including a thermoplastic hub having a durometer of about Rockwell R120, for example, and a thermoplastic elastomer tread which is molded over the hub and is of a durometer of about 70 to 90 Shore A. The hub and tread are both, preferably, formed of a suitable urethane compound wherein the hub and the tread are strongly bonded together.

In accordance with a still further aspect of the present invention, a dual durometer roller guide member is provided for use, in particular, with track guided upward-acting doors and wherein the roller is provided with a low durometer thermoplastic elastomer tread of a configuration which assures quiet and reliable operation while minimizing drag or friction forces between the rollers and the guide tracks and also avoiding the rollers undergoing lateral oscillation or "climbing" of the side walls of channel shaped guide tracks.

Those skilled in the art will further appreciate the above-mentioned advantages and superior features of the invention together with other important aspects thereof upon reading the detailed description which follows in conjunction with the drawing.

DETAILED DESCRIPTION OF PREFERRED EMBODIMENTS

Figure 1:
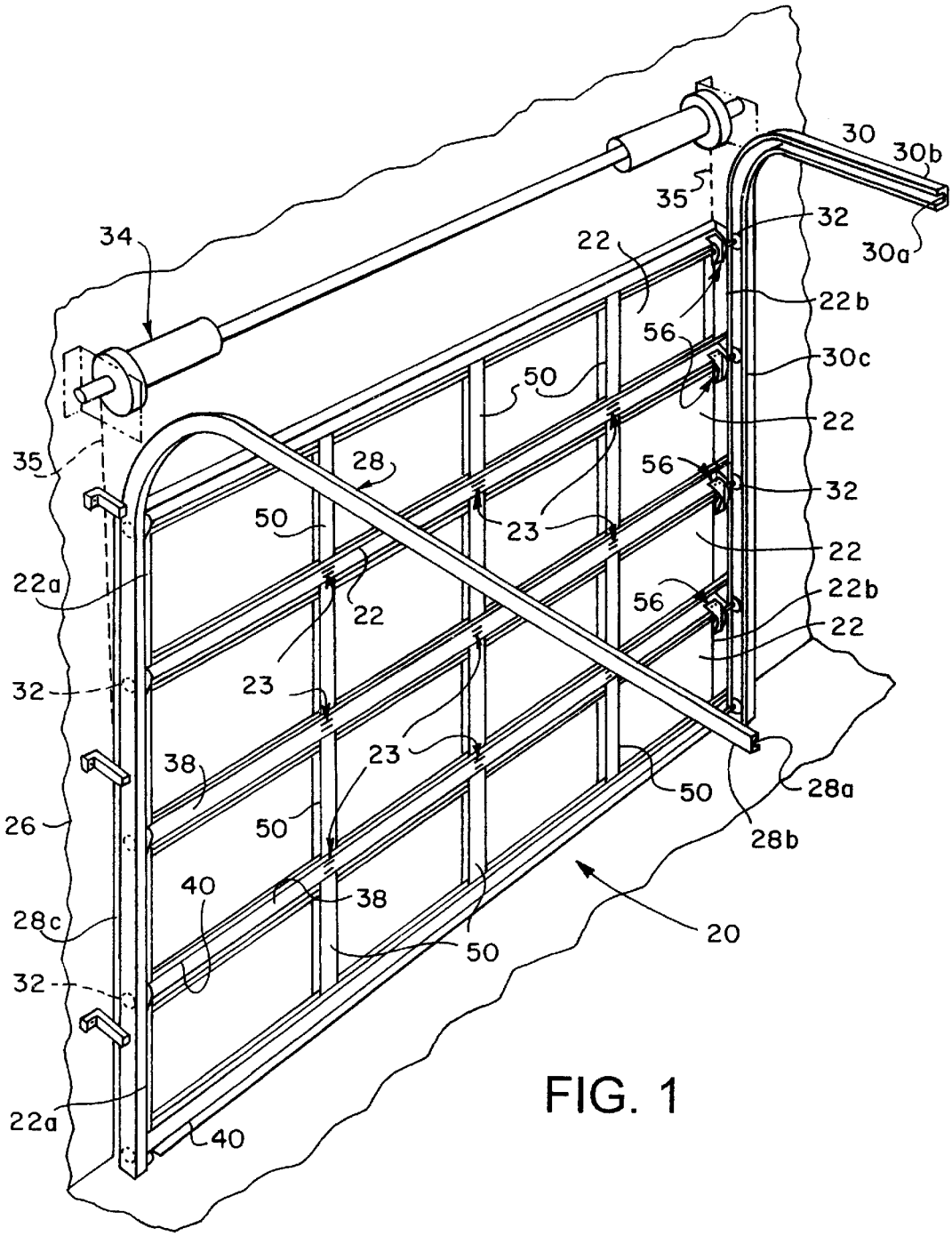
FIG. 1 is a perspective view of a sectional upward-acting track guided door which includes roller guide members in accordance with the invention.

In the description which follows, like parts are marked throughout the specification and drawing with the same reference numerals, respectively. The drawing figures are not necessarily to scale in the interest of clarity and conciseness.

Referring to FIG. 1, there is illustrated an upward-acting track guided door 20 disposed to move between a closed position shown covering an opening in a wall 26 and an open position guided and supported by opposed somewhat channel-shaped guide tracks 28 and 30. The guide track 28 includes a channel-shaped recess 28*a* extending along a horizontal run portion 28*b* and a vertical run portion 28*c*. In like manner, guide track 30 is a mirror image of guide track 28 and includes a channel-shaped recess 30*a* which extends along a horizontal run portion 30*b* and a contiguous vertical run portion 30*c*. One preferred embodiment of a guide roller in accordance with the invention is indicated by numeral 32 in FIG. 1. Each of the guide rollers 32 is supported in a suitable manner on spaced-apart support brackets to be described in further detail herein, which brackets are mounted on opposite lateral sides of plural sectional door panels 22, respectively. The door panels 22 are delimited by opposite lateral side edges 22*a* and 22*b*. The panels 22 are also joined together by suitable hinges 23 and are delimited by longitudinal side edges 38 and 40, respectively. The panels 22 may be reinforced by plural spaced-apart vertically extending support members or stiles 50, as shown in FIG. 1. A suitable counterbalance mechanism 34 is operably connected to the door 20 by depending flexible cable type members 35 in a conventional manner. The door 20 may be of a type disclosed in my U.S. patent application Ser. No. 09/570,618 on May 15, 2000 and assigned to the assignee of the present invention. Moreover, the counterbalance mechanism may be of a type covered by U.S. Pat. No. 6,134,835 issued on Oct. 24, 2000 and also assigned to the assignee of the present invention. However, those skilled in the art will also recognize that the roller guide members 32 may be used on other types of sectional or single-piece track guided doors.

Figure 2:
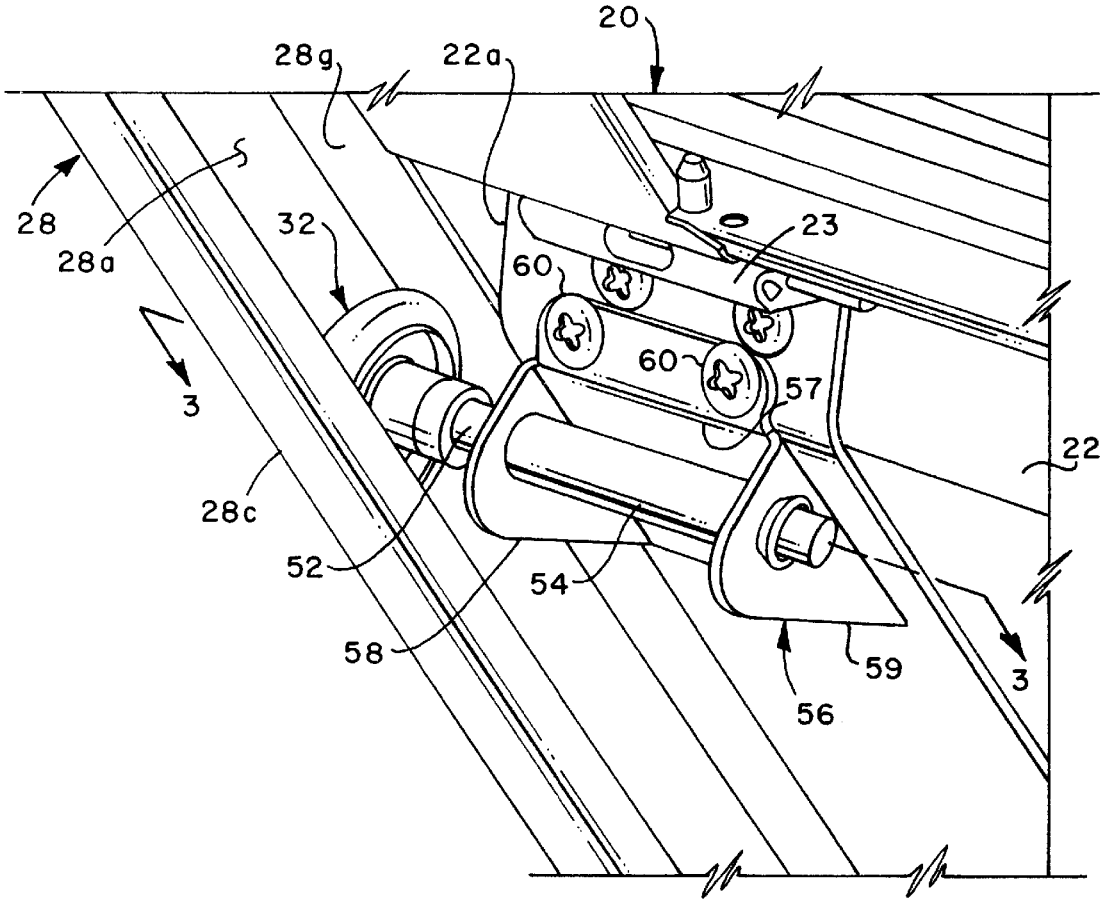
FIG. 2 is a detail perspective view of one of the guide members mounted on a support bracket which, in turn, is mounted on one of the door sections for the door shown in FIG. 1.

Referring now to FIG. 2, one of the guide rollers 32 is shown in a working position disposed within the channel-shaped recess 28*a* of track section 28*c*. In one preferred arrangement for the guide roller 32, the roller is mounted on a support shaft 52 which is disposed in an elongated tubular support or bearing member 54 secured to and forming a part of a support bracket 56. Support bracket 56 includes a base or web portion 57 and opposed parallel flanges 58 and 59 integrally formed with the web portion 57 and extending normal thereto. Tubular bearing member 54 may be formed as a separate member and suitably secured to the flanges 58 and 59 and extending through coaxial bores 58*a* and 59*a*, see FIG. 3. As shown in FIG. 2, support bracket 56 is secured to a door panel 22 by suitable fasteners 60, for example. Further details of the support bracket 56 may be determined from U.S. patent application Ser. No. 09/570,618, the subject matter of which is incorporated herein by reference. Each of the guide roller members 32 for the door 20 may be mounted in a similar manner.

Figure 3:
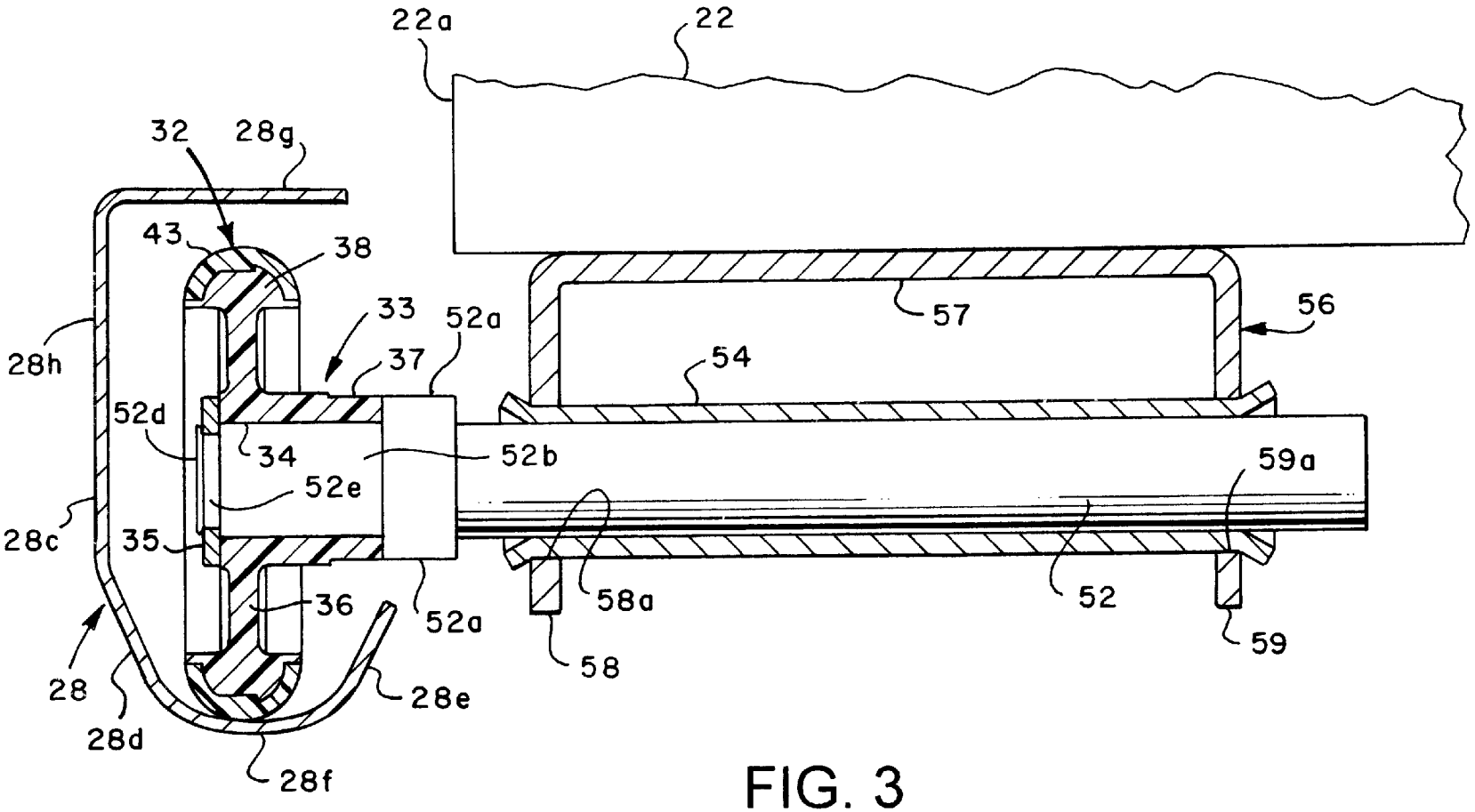
FIG. 3 is a longitudinal central section view taken generally along the line 3—3 of FIG. 2.

Referring further to FIG. 3, by way of example, the track 28 defines the channel 28*a* by opposed diverging side walls 28*d* and 28*e* interconnected by a generally planar section 28*f* which is disposed opposite a substantially planar flange 28*g*. Flange 28*g* is joined to side wall 28*d* by a suitable web portion 28*h*. Track side walls 28*d* and 28*e* join section 28*f* by substantially constant circular radii which are somewhat larger than the radius of curvature, in cross section, of the outer surface of guide roller 32. Moreover, the spacing between side walls 28*d* and 28*e* is sufficient to allow some longitudinal movement of guide roller 32 and support shaft 52 within the tubular bearing member 54.

As further shown in FIG. 3, guide roller support shaft 52 includes an integral collar 52*a* and a stub-bearing portion 52*b* for supporting a hub 33 of guide roller 32. Hub 33 includes a suitable bore 34 journaling the stub shaft 52*b*. Hub 33 is retained on support shaft 52 by a retaining washer 35 which, in turn, is retained on the shaft 52 by staking or coining the shaft end face 52*d* to enlarge same and retain the washer 35 thereon. Washer 35 is preferably mounted on a slightly reduced diameter portion 52*e* of stub shaft 52*b*, as shown in FIG. 3.

Figure 4:
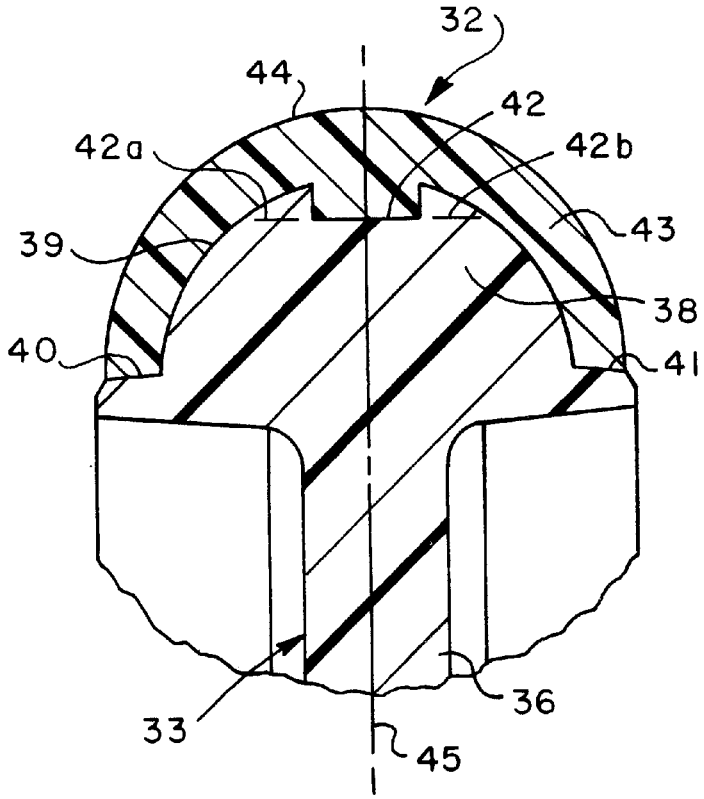
FIG. 4 is a detail section view showing the configuration of the over-molded tread or tire for one preferred embodiment of the guide roller of the present invention.

Referring further to FIG. 3 and also FIG. 4, the roller hub 33 includes a circumferential radially extending web 36 integrally joined to an outer circumferential rim portion 38 and to a hub bearing portion 37. As shown in FIG. 4, in particular, rim portion 38 has an outer convex arcuate surface 39 extending between spaced-apart circumferential shoulders 40 and 41. A circumferential recess 42 is also provided in surface 39 and is substantially centered and aligned with the web 36, for example. The radius of curvature of surface 39 is preferably constant and extends between the shoulders 40 and 41 and is interrupted only by the recess 42. The hub 33 is preferably molded of a thermoplastic. A urethane composition having a durometer of approximately Rockwell R 120 is preferred.

Referring further to FIGS. 3 and 4, the roller 32 also includes a circumferential outer tire or tread 43 which has an arcuate outer surface 44, FIG. 4, and extends between the shoulders 40 and 41, as illustrated. The outer tread 43 is preferably secured to the hub 33 by molding the tread 43 over the rim 38 in a two-step molding process which forms both the hub and the tread. However, the tread 43 may be formed or placed over the rim 38 in a different manner. The thickness of the tread 43 may be varied. However, for a roller 32 having an outer diameter of about 1.75 inches, the thickness of the tread 43 may range from about 0.03 inches to 0.07 inches. The tread 43 is preferably formed of a rubber or thermoplastic elastomer (TPE) and having a durometer of about 70 to 90 Shore A. In a preferred manner of fabricating the roller 32, the tread 43 is molded over the hub 33 without removing the hub 33 from a mold in which the hub itself was formed. The overmolding process assures a strong bond between the rim 38 of hub 33 and the tread 43.

The extent of the arcuate surface 44 about its own axis is preferably about 180°, although the angular extent of the surface 44 may be less as will be explained in further detail in conjunction with an alternate embodiment of the invention. The cross section of the rim 38 and tread 43 may be symmetrical about a plane 45 centered in the web 36, FIG. 4, although the tread may be formed asymmetrical about the centerline or plane 45. Recess 42 may be relieved along lines 42*a* or 42*b* to intersect surface 39, as indicated in FIG. 4, to facilitate molding the tread 43 over the rim 38.

Figure 5:
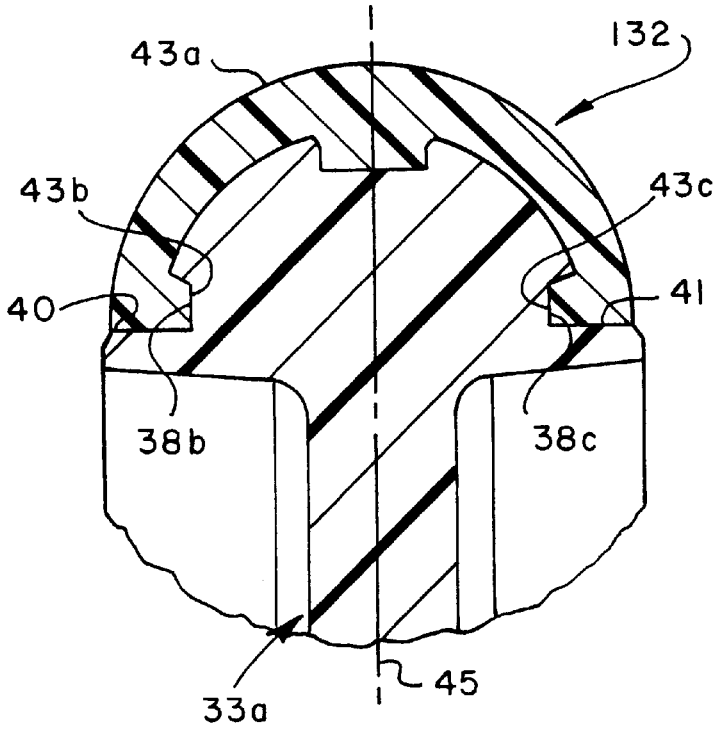
FIG. 5 is a view similar to FIG. 4 showing a first alternate embodiment of a guide roller in accordance with the invention.

Referring briefly to FIG. 5, there is illustrated a guide roller 132 comprising a first alternate embodiment of the invention and modified as shown to form a rim 38*a* for a hub 33*a*. A tread 43*a* is overmolded the rim 38*a* and is substantially like the tread 43 except the rim 38*a* has been modified to provide two opposed annular grooves 38*b* and 38*c* adjacent the shoulders 40 and 41 and effectively extending the axial extent of the shoulders 40 and 41. Accordingly, when the tread 43*a* is molded over the rim 38*a*, two annular reentrant flanges 43*b* and 43*c* are formed which may further enhance retention of the tread 43*a* on the rim 38*a*. The configuration of guide roller member 132 may be preferred where the tread is not over molded on the hub of the roller. Thus, the reentrant flanges 43*b* and 43*c* aid in retaining the tread on the roller hub.

Figure 6:
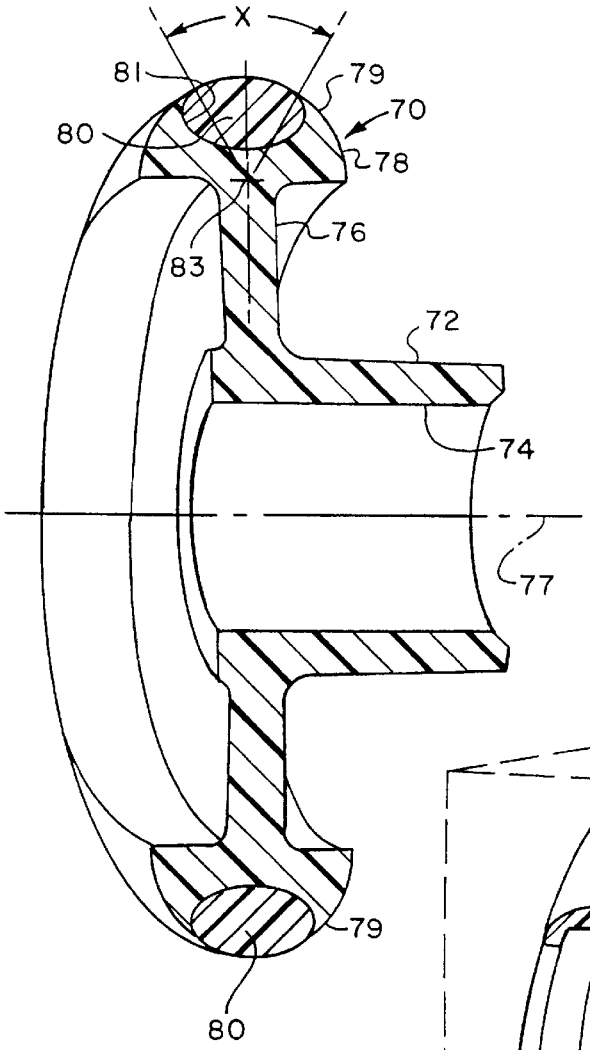
FIG. 6 is a section view of a second alternate embodiment of a guide roller in accordance with the present invention.

Referring now to FIG. 6, a second alternate and also preferred embodiment of a guide roller in accordance with the invention is illustrated and generally demonstrated by the numeral 70. The guide roller 70 is provided with a hub 72 including an axial bore 74 for receiving a stub shaft 52*b*, not shown, on a support shaft 52, also not shown, whereby the roller 70 may be retained on such support shaft in the same manner as the rollers 32 and 132. Hub 72 includes a circumferential radially extending web portion 76 integrally formed with a circumferential rim 78 having an arcuate outer surface 79. As further shown in FIG. 6, a somewhat elliptical cross-section shaped tread or tire 80 is disposed in a circumferential recess or groove 81 formed in the rim 78. The tread 80 is also preferably molded over the rim 78 of the hub 72 and is exposed to the exterior surface 79 of rim 78 within an included angle X, FIG. 6, of about 60° to 90° with respect to the center 83 of the cross sectional shape of the rim 78 as defined by arcuate surface 79 whereby the tread or tire 80 does not extend over an arc as great as the tread or tire of the rollers 32 or 132. In this way, the relatively soft tire or tread 80 may be less likely to frictionally engage the side walls 28*d* or 28*e* of the track 28 (as well as the same or corresponding side walls of the track 30) so that there is less drag on the door operator and less tendency for the roller 70 to oscillate or tend to move in a lateral manner with respect to the tracks, which manner would be moving axially of the central axis of rotation 77 for the roller and the shaft 52, for example. The hub 72, web 76, rim 78 and the tread or tire 80 may be formed of the same or similar materials as provided for the hub and tread of the roller 32.

Figure 6A:
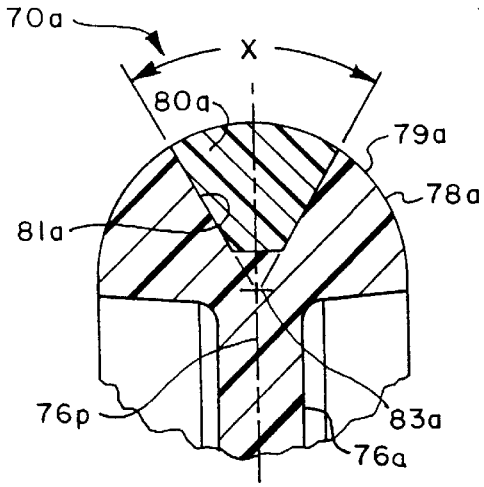
FIG. 6A is a detail section view of a third alternate embodiment of a guide roller in accordance with the invention.

Referring briefly to FIG. 6A, a further modification of a guide roller in accordance with the invention is illustrated and generally designated by the numeral 70*a*. The roller 70*a* includes a modified hub which includes a radially extending web portion 76*a* and a rim 78*a* in which a somewhat circular segment shaped notch or recess 81*a* is provided in a circumferential manner. The rim 78*a* includes a somewhat circular cross sectional shape having a center at 83*a* which is coincident with a plane passing through the center of the web 76*a* as indicated at 76*p*. Center 83*a* preferably coincides with the center of arcuate surface 79*a* of rim 78*a*. The angle X is defined about the plane 76*p* and the center 83*a* and may range between about 60° to 90°, thus defining the sidewalls of the recess 81*a*, as shown. A thermoplastic elastomer tire or tread 80*a* is molded over and bonded to the rim 78*a* within the recess 81*a*.

Figure 7:
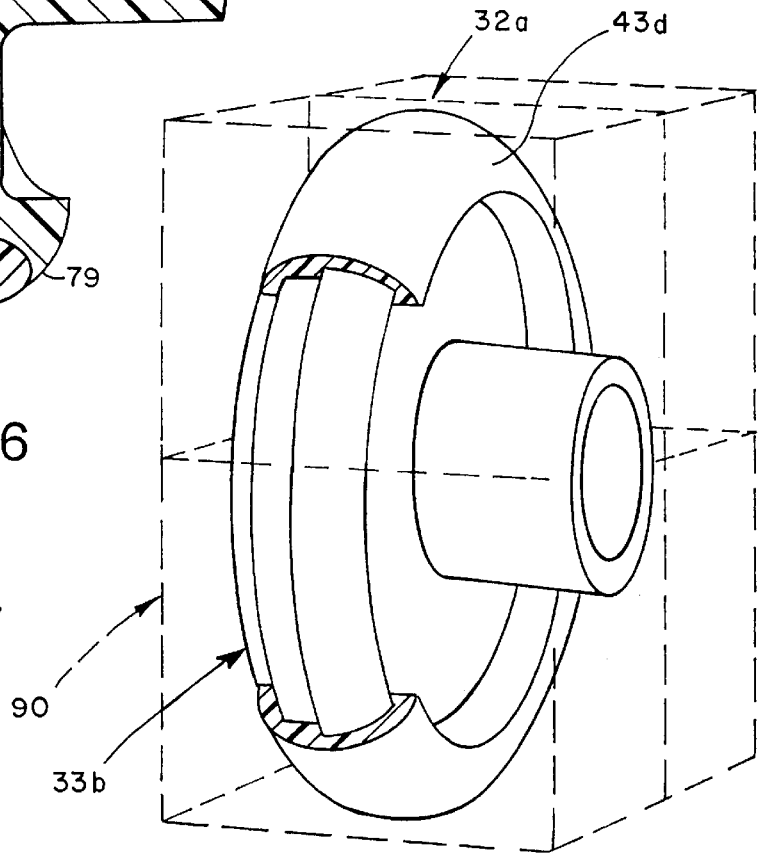
FIG. 7 is a perspective view, in somewhat schematic form, showing a guide roller in accordance with the invention disposed within a mold which may be expanded to provide a two-step molding process for molding the hub and then the tread or tire of the guide roller.

Referring briefly to FIG. 7, a further modified roller 32*a* is shown disposed in a suitable multi-part mold 90 which may be placed in a first position to form a mold cavity which is delimited by surfaces which will only form the hub 33*b* of the roller 32, for example. However, the mold 90 may be expanded, after molding the hub 33*b*, such that a mold cavity space is provided corresponding to the space occupied by a tread 43*d*. After the mold 90 is expanded to provide the molding space corresponding to that required to form the tread 43*d*, tread-forming material is injected into the mold and is thus integrally joined or bonded to the previously molded hub 33 so that the roller 32*a* does not require removal from the mold until the hub and the overmolded tread are formed. Moreover, a superior bond may be provided between the tread 43*d* and the hub 33*b* of the guide roller 32*a* since, for example, the overmolding process may take place only shortly after the hub material solidifies in the process of molding the hub. All embodiments of the guide roller of the present invention may be molded in generally the same manner.

The construction and operation of the guide rollers disclosed herein and shown in the accompanying drawing figures may be carried out as described and which is believed to be sufficient to enable those skilled in the art to practice the invention. Although preferred embodiments have been disclosed in detail herein, those skilled in the art will recognize that various substitutions and modifications may be made without departing from the scope and spirit of the appended claims.

What is claimed is:

1. A guide roller member for a track guided door which is supported and guided by opposed guide tracks, comprising:

a hub including a circumferential rim and adapted to be connected to a support shaft for supporting said guide roller by a support bracket connected to said door, said rim including a circumferential recess formed in an outer surface of said rim; and a tread disposed in said recess and forming at least part of said outer surface, said tread being engageable with one of said guide tracks and formed of a material having a lower durometer than said hub.

2. The guide roller member set forth in claim 1 wherein:

said hub is formed of a thermoplastic material having a durometer of about Rockwell R 120.

3. The guide roller member set forth in claim 2 wherein:

said tread is formed of an elastomer having a durometer of about 70 to 90 Shore A.

4. The guide roller member set forth in claim 1 wherein:

said tread is molded over said hub.

5. The guide roller member set forth in claim 1 wherein:

said outer surface of said rim is delimited by spaced-apart circumferential shoulders and said tread extends over said rim between said shoulders.

6. The guide roller member set forth in claim 1 wherein:

said rim includes opposed circumferential grooves and said tread includes opposed reentrant flange portions extending into said grooves to aid in retaining said tread on said hub.

7. The guide roller member set forth in claim 1 wherein:

said hub and said tread are formed in a molding operation including a mold wherein said hub is not removed from said mold prior to forming said tread by molding said tread onto said hub.

8. A guide roller member for a track guided door which is supported and guided by opposed guide tracks, comprising:

a hub adapted to be connected to a support shaft for supporting said guide roller by a support bracket connected to said door, said hub includes a bearing portion, a radially extending web and a circumferential rim, said rim having a convex arcuate outer surface and a circumferential recess in said outer surface; and a tread supported by said hub and disposed in said recess and extending at least partially over said outer surface and engageable with one of said guide tracks, said tread being formed of a material having a lower durometer than said hub.

9. A guide roller member for a track guided door which is supported and guided by opposed guide tracks, comprising:

a hub adapted to be connected to a support shaft for supporting said guide roller by a support bracket connected to said door, said hub including a bearing portion, a radially extending web and a circumferential rim, said rim having an outer surface; and a tread supported by said hub and engageable with one of said guide tracks, said tread extending over a portion of said outer surface of said rim but less than the full extent of said outer surface when viewed in cross-section as taken through an axis of rotation of said guide roller member, and said tread being formed of a material having a lower durometer than said hub.

10. A guide roller member for a track guided door which is supported and guided by guide track means, comprising:

a hub adapted to be connected to a support shaft for supporting said guide roller by a support bracket connected to said door, said hub including a bearing portion, a radially extending web and a circumferential rim, said rim including a circumferential recess in an outer surface of said rim; and a tread supported by said hub and engageable with one of said guide tracks, said tread extending over at least part of said rim and disposed in said recess to form part of said outer surface of said rim, said tread being formed of a material having a durometer different than said hub.

11. The guide roller member set forth in claim 10 wherein:

said tread is disposed over less than the full extent of said outer surface when viewed in cross-section as taken through an axis of rotation of said guide roller member.

* * * * *